US005199795A

United States Patent [19]

Russo et al.

[11] Patent Number: 5,199,795

[45] Date of Patent: Apr. 6, 1993

[54] PACKAGING FOR SHIPMENT AND CONTAINMENT OF HAZARDOUS WASTES

[75] Inventors: Joseph D. Russo, Palo Alto; Laurence M. Russo, Oakland, both of Calif.

[73] Assignee: Rousseau Research, Inc., Palo Alto, Calif.

[21] Appl. No.: 821,267

[22] Filed: Jan. 10, 1992

Related U.S. Application Data

[63] Continuation of Ser. No. 534,725, Jun. 7, 1990, abandoned, which is a continuation of Ser. No. 278,585, Dec. 1, 1988, abandoned, which is a continuation-in-part of Ser. No. 257,725, Oct. 14, 1988, Pat. No. 4,969,750.

[51] Int. Cl.[5] ..... B65D 30/08

[52] U.S. Cl. ..... 383/113; 383/84; 206/204; 604/408; 604/409

[58] Field of Search ..... 206/204, 523, 524.5; 383/63, 84, 94, 109, 110, 113; 604/374, 378, 408, 409

[56] References Cited

U.S. PATENT DOCUMENTS

| | | | |
|---|---|---|---|
| 2,962,158 | 11/1960 | Struthers | 383/94 X |
| 2,987,174 | 6/1961 | Free et al. | 206/46 |
| 3,272,371 | 9/1966 | Weiner | 217/26.5 |
| 3,707,227 | 12/1972 | Britt | 206/65 R |
| 3,746,161 | 7/1973 | Jones | 206/72 |
| 3,948,436 | 4/1976 | Bambara | 206/523 |
| 3,986,914 | 10/1976 | Howard | 383/63 X |
| 3,999,653 | 12/1976 | Haigh et al. | 206/524.05 X |
| 4,213,528 | 7/1980 | Kreutz et al. | 206/204 X |
| 4,224,416 | 9/1980 | Taylor et al. | 521/94 |
| 4,240,547 | 12/1980 | Taylor | 206/204 |
| 4,267,928 | 5/1981 | Curry, Jr. | 206/583 |
| 4,282,984 | 8/1981 | Curry, Jr. | 220/404 |
| 4,361,226 | 11/1982 | Travis | 206/45.31 |
| 4,407,897 | 10/1983 | Farrell et al. | 206/204 |
| 4,495,082 | 1/1985 | Mita et al. | 252/194 |
| 4,501,360 | 2/1985 | Levy et al. | 206/443 |
| 4,572,361 | 2/1986 | Fontlladosa | 206/45.19 |
| 4,572,371 | 2/1986 | Asenbauer | 206/443 |
| 4,573,578 | 3/1986 | Greminger, Jr. et al. | 206/524.5 X |
| 4,597,765 | 7/1986 | Klatt | 623/11 |
| 4,615,923 | 10/1986 | Marx | 428/35 |
| 4,619,361 | 10/1986 | Thomas, Jr. | 206/204 |
| 4,620,633 | 11/1986 | Lookholder | 206/523 |
| 4,637,061 | 1/1987 | Reise | 383/38 |
| 4,679,688 | 7/1987 | Söderhold et al. | 206/204 |
| 4,699,622 | 10/1987 | Toussant et al. | 604/389 |
| 4,706,996 | 11/1987 | Fasham | 229/71 X |
| 4,735,308 | 4/1988 | Barner | 383/109 X |
| 4,735,843 | 4/1988 | Noda | 428/137 |

(List continued on next page.)

*Primary Examiner*—Allan N. Shoap
*Assistant Examiner*—Jes F. Pascua
*Attorney, Agent, or Firm*—Jacques M. Dulin

[57] ABSTRACT

The present invention pertains to a method of packaging hazardous liquids for shipment or containment, and to the structure and composition of the packaging which can be used to practice the method.

The method comprises packaging a hazardous liquid for shipment or containment wherein the hazardous liquid, present in at least one sealed container or in a leaking container, respectively, is placed in a package which can be sealed so that the package completely surrounds and isolates the container, wherein the improvement comprises:

constructing the packaging material so that it comprises at least two layers, including an interior layer and an exterior layer, wherein the interior layer of the packaging material adjacent to the sealed or leaking container can be penetrated by liquid which escapes from the container, and wherein the exterior layer of the packaging material, the external portion of which is in contact with the external environment, is impermeable by the liquid and by hazardous vapor therefrom. Typically the packaging material is comprised of three layers, the interior, permeable layer, an adjacent layer which comprises an absorbent or adsorbent, and the exterior impermeable layer.

13 Claims, 3 Drawing Sheets

U.S. PATENT DOCUMENTS

| | | | |
|---|---|---|---|
| 4,736,850 | 4/1988 | Bowman et al. | 206/570 |
| 4,738,674 | 4/1988 | Todd et al. | 604/361 |
| 4,738,675 | 4/1988 | Buckley et al. | 604/379 |
| 4,740,528 | 4/1988 | Garvey et al. | 521/128 |
| 4,742,908 | 5/1988 | Thomas, Jr. et al. | 206/204 |
| 4,744,374 | 5/1988 | Deffeves et al. | 131/331 |
| 4,748,069 | 5/1988 | Cullen | 428/195 |
| 4,748,076 | 5/1988 | Saotome | 428/224 |
| 4,748,977 | 6/1988 | Guyot et al. | 128/156 |
| 4,753,643 | 6/1988 | Kassai | 604/359 |
| 4,753,834 | 6/1988 | Braun et al. | 428/74 |
| 4,755,405 | 7/1988 | Massucco et al. | 206/807 |
| 4,756,937 | 7/1988 | Mentzer | 428/2 X |
| 4,758,239 | 7/1988 | Yeo et al. | 604/366 |
| 4,784,267 | 11/1988 | Gessler et al. | 206/438 |
| 4,815,605 | 3/1989 | Brissier et al. | 206/523 |
| 4,826,003 | 5/1989 | Levy | 206/523 X |
| 4,861,632 | 8/1989 | Caggiano | 383/109 X |
| 4,890,936 | 1/1990 | Cooper | 383/109 |
| 4,903,827 | 2/1990 | Phelps et al. | 206/204 |
| 4,927,010 | 5/1990 | Kannankeril | 206/204 |
| 4,949,840 | 8/1990 | Brown | 206/204 |

PACKAGING FOR SHIPMENT AND CONTAINMENT OF HAZARDOUS WASTES

CROSS REFERENCE TO RELATED APPLICATIONS

This application is a continuation of application Ser. No. 07/534,725, filed Jun. 7, 1990, now abandoned, which application Ser. No. 07/534,725 is a continuation of application Ser. No. 07/278,585, filed Dec. 1, 1988, now abandoned, which application Ser. No. 07/278,585 is a continuation-in-part of application Ser. No. 07/257,725, filed Oct. 14, 1988, now U.S. Pat. No. 4,969,750, issued Nov. 19, 1990.

Applicants also are inventors of their co-pending application Ser. No. 07/439,638, filed November 1989, entitled Universal Diagnostic Packaging, relating to universal medical diagnostic sample trays which may be used alone or in combination with the pouch of the present invention, and the disclosure of that application Ser. No. 07/439,638 is herewith incorporated by reference to the extent need be to satisfy the requirements of title 35 U.S. Code.

BACKGROUND OF THE INVENTION

1. Field of the Invention

This invention pertains to a method of packaging hazardous liquids for shipment or containment and to the structure and composition of the packaging which can be used to practice the method.

2. Background Art

The business needs of today frequently require shipment of one or more individual containers of liquid, wherein the individual containers can be as small as a test tube or as large as a bulk container for an industrial chemical (which may be 24 inches in diameter or more). The liquid to be shipped can comprises chemical compounds, synthetic polymers, aromatics, hydrocarbons, biological materials, and radioactive materials, for example. The liquid may comprise a solution, a suspension, or a dispersion, each having different flow characteristics and different reactive capabilities. It is not uncommon that the liquid to be shipped is toxic or contains biologically active or reactive components which present a danger to persons who are exposed to the fluid without the proper protective barrier clothing, eye protection and respiratory equipment.

Even when the packaging in which hazardous liquids are shipped is carefully marked with warnings to alert those who will be handling the shipment to use special care, there is always the possibility the liquid will escape from a package damaged during shipment, exposing those persons handling the package to potential harm. Thus, the packaging in which hazardous liquids are sipped should be capable of preventing the escape of the liquid being shipped and any hazardous vapors thereof.

Inadequacies in existing packaging means recently became apparent when medical doctors searched for packaging which could be used for shipment of blood test kits to outside testing laboratories. The existing shipping method provides for shipping of test tube samples of blood in a formed styrofoam tray which is placed in a gusseted envelope. However, on occasion during shipment, breakage of the test tubes occurs due to rough package handling, causing blood to leak out the edges of the styrofoam tray or cracks or breaks in the tray. Should the blood be contaminated with such as a deadly virus, persons handling the package are thereby exposed to a potentially life threatening hazard. Similar considerations apply to urine specimans, biohazardous fluids in general, and toxic solutions. At this time, the U.S. Postal Service is considering a ban on shipment of disease causing germs or hazardous toxins (etiological agents).

It is possible to provide packaging which is capable of protecting the liquid container better; it is possible to provide a liquid container which cannot be crushed. Examples of materials which can be used to fabricate such packaging or liquid containers include fiberglass, metals, and reinforced composites of the type commonly used in the chemical industry. However, such packaging or containers are very expensive to manufacture, and reuse requires special tracking during shipment and costly cleaning procedures. The stronger packaging and containers would typically be heavier, increasing shipping costs and making handling more difficult. Containers comprised of fiberglass or metal canisters and bombs are less convenient to use; doctors and nurses prefer tray-form packages for tabletop convenience in laying out tubes of blood and slides.

Examples of subject matter related to the present invention include the U.S. patents listed below.

U.S. Pat. No. 3,986,914 to Howard, dated Oct. 19, 1976, described a plastic pouch-like container which is provided with a plastic bead seal at the junction of an interlocking fastener and the side edges of the container. The plastic bead seal acts as a barrier to prevent leakage of fluids or contaminating bacteria through the plastic container in the area adjacent to the fastener/closure of the container.

U.S. Pat. No. 4,267,928 to Curry, Jr., dated May 19, 1981, describes a composite structure container for commercial use in transporting fluids. The container is a composite paper body with a plastic liner forming a structure that is adapted to be sealed with a crimped-on cap, to preserve items stored in the container either under atmospheric pressure, vacuum, or pressurized conditions.

U.S. Pat. No. 4,282,984 to Curry, Jr., dated Aug. 11, 1981, describes a composite container structure similar to that described in U.S. Pat. No. 4,267,928, including use of a resinous tube surrounding the outside of the composite structure, which tube can be shrunk into place over the outer surface of the structure to form a seal.

U.S. Pat. No. 4,495,082 to Mita et al., dated Jan. 22, 1985, describes a water absorbant excellent in water holding capacity under pressure. The absorbant comprises a mixture of a cotton-like material "A" manufactured by a pulping treatment of bagasse containing at least 5 percent by weight of pith and having a lignin content of 5–25 percent by weight and a pulp "B" having a lignin content not greater than 5 percent by weight, wherein the weight ratio of A:B ranges from 95:5 to 20:80.

U.S. Pat. No. 4,572,361 to Fontlladosa, dated Feb. 25, 1986, describes a means for the packaging and orderly display of consumer fluid product containers. The means provides for holding the consumer fluid product containers which are of a tube type in fixed, closely packed positions, to prevent damage during shipment.

U.S. Pat. No. 4,597,765 to Klatt, dated Jul. 1, 1986, discloses a method and apparatus for packaging a fluid containing prothesis.

U.S. Pat. No. 4,615,923 to Marx, dated Oct. 7, 1986, describes a water-absorbing insert for food packs. The insert is adapted to be used in direct abutment with food, and comprises an outer covering and an inner filling. The outer covering is pervious to water is is preferably made from an acid-free paper. The filler includes kieselguhr and an organic gel former selected from the group consisting of carboxymethyl cellulose, cellulose ether, polyvinylpyrrolidon, starch, dextrose, gelatin and pectin.

U.S. Pat. No. 4,735,843 to Noda, dated Apr. 5, 1988, describes selectively surface-hydrophilic porous or perforated sheets. The fluid-directed front face of the sheet comprises a hydrophilic perforated surface having a multiplicity of holes for fluid passage. The back face of the sheet is coated with a rubber-like material insoluble in aqueous fluid but having surface-hydrophilic properties, whereby the back face of the sheet is rendered hydrophilic. The sheets are particularly useful as cover sheets for absorbant structures such as diapers, bandages and catamenials.

U.S. Pat. No. 4,738,674 to Todd et al., dated Apr. 19, 1988, describes a method for automatically and continuously indicating wetness of diapers, hospital underpads, and the like, wherein moisture indicator strips of a capillary action type are used to provide a visual indication of wetness at a point removed from the actual point of wetness. A wicking strip is used to transfer the moisture to a moisture indicating substance which visually indicates the presence of moisture.

U.S. Pat. No. 4,738,675 to Buckley et al., dated Apr. 19, 1988, describes a disposable diaper comprising a fluid impervious back sheet, a fluid pervious front sheet, a first absorbant pad adjacent the front sheet and comprising a loosely formed fiberous mass, and a separate second absorbent pad between the first pad and the back sheet. The second pad comprises a mass of fibers having compressed regions extending throughout a substantial part of the second pad and having relatively uncompressed areas adjacent the compressed regions. The compressed regions are used to promote the spreading of fluid throughout the pad, and to direct fluid flow against the force of gravity when the diaper is positioned on the baby.

U.S. Pat. No. 4,740,528 to Garvey et al., dated Apr. 26, 1988, describes an absorbent superwicking crosslinked polyurethane foam composition into which is incorporated an effective amount of at least one amino acid, a one percent by weight aqueous solution of which has a pH of no more than about 8. Said amino acid contains one amino acid group and at least one carboxylic acid group. The polyurethane foam composition is useful as a sponge and in the manufacture of such absorbent composite structures as disposable diapers, incontinent products, etc.

U.S. Pat. No. 4,744,374 to Deffeves et al., dated May 17, 1988, discloses a family of crystalline, microporous silaceous materials of regular geometry which are substantially hydrophobic and which exhibit a stronger affinity for less polar molecules such as ammonia than for water under equivalent exposure conditions. Such silacious materials would be useful in fabrication of filter cartridges for pipes, cigars or cigarettes, and would be expected to absorb significant amounts of carbon monoxide from mainstream smoke more effectively than previously used hydrophilic materials. The hydrophobic material comprises microporous crystalline tectosilicate of regular geometry having aluminum-free sites in a silaceous lattice that are characterized by the presence of about 1–4 associated moieties in said sites of the formula—SiOR, wherein R is a substituent that is a weaker point source than aluminum.

U.S. Pat. No. 4,748,069 to Cullen, dated May 31, 1988, describes a liquid absorbing and immobilizing packet and paper therefor. The packet comprises an envelope which is degradable in the liquid and a liquid absorbing and immobilizing material in the envelope. The liquid absorbing and immobilizing material recommended for aqueous solutions including dilute alkalis, dilute acids, and body fluids is sodium polyacrylate. The envelope can comprise a layer of a liquid degradable material having a patterned coating of sealing material in the layer, wherein the pattern is such that uncoated portions of the envelope remain exposed to be degraded by contact with the liquid.

U.S. Pat. No. 4,748,076 to Saotome, dated May 31, 1988, describes a water absorbent fiberous product comprising a cellulosic material impregnated with a water absorbent acrylic polymer. The fiberous product exhibits a high water absorbency and finds applications as high quality disposable diapers, sanitary napkins, surgical pads, surgical sheets, paper towels or the like.

U.S. Pat. No. 4,748,977 to Guyot et al., dated Jun. 7, 1988, describes a mineral fiber-based absorbent material. The absorbent material is comprised at least partially of mineral fibers which have a specific surface area greater than 0.25 $m^2/g$. The fibers have an average diameter under 5 micrometers, having a homogeneous size distribution and are free of non-fibrated or clustered particles. The mineral fiber-based material typically comprises a glass fiber.

U.S. Pat. No. 4,753,643 to Kassai, dated Jun. 28, 1988, describes a disposable diaper. The disposable diaper comprises an inner member to be in contact with the skin of a wearer, an outwardly directed member, and an absorbent member interposed between the same. Baby powder is retained in a pulverulent state in cavities or wrinkles defined in the inner member by gathers.

U.S. Pat. No. 4,753,834 to Braun et al., dated Jun. 28, 1988, discloses a nonwoven web with improved softness, tensile strength, and tear resistance. The nonwoven web comprises monofilaments or fibers of a thermoplastic material, wherein the improvement comprises the use of monofilaments or fibers which have a biolobal-shaped cross section.

U.S. Pat. No. 4,758,239 to Yeo et al., dated Jul. 19, 1988, describes a breathable barrier. The barrier includes a first layer which is a porous sheet having a first side and a second side. A second layer is joined to the first side of the first layer, which second layer is a continuous film of a water soluble polymeric material, in which the film is not microporous in that it is substantially free of voids which connect the two surfaces of the film. Water molecules are capable of being transported through the second layer film as a result of the solubility of the water molecule in the polymeric material. The second layer film has an average thickness of from about 3 to about 250 microns. The first layer side of the second layer film is intimately comingled with at least some of the fibers at the surface of the first side of the first layer, and none of the pores at the surface of the first side of the first layer are so large as to significantly adversely affect the barrier properties of the breathable barrier as a consequence of the comingling.

There are additional patents related to adsorbent and absorbent materials, to immobilizing additives and compounds and to the structure of multilayer sheets and pads designed to utilize such materials, additives, and compounds. The above-cited U.S. patents are offers as examples closely related to the subject matter of the present invention. The relationship of such subject matter to the present invention will become more apparent upon reading the summary and detailed description of the present invention.

The problem of hazardous liquid leaking from a package to expose those not equipped or trained to handle such liquids can be greatly reduced or eliminated by shipping the hazardous liquid in a package designed to prevent the liquid or hazardous vapors thereof from penetrating the exterior of the package should a container inside the package fail during shipment. There is a need for a package means which accomplished this goal in a relatively inexpensive manner.

There is also a need for a package which can be used to contain a known hazardous liquid leakage, such as a leak from industrial pails or drums. The kind of package which can be used for shipping of hazardous liquids can also be used for containment of such leaking vessels by techniques such as shrouding the leaking vessel in the package, inverting, and then sealing the package.

SUMMARY OF THE INVENTION

The method of the present invention comprises a method of packaging a hazardous liquid for shipment, wherein the hazardous liquid, present in at least one sealed container, is placed in a package which can be sealed so that the package completely surrounds and isolates the sealed container, wherein the improvement comprises:

constructing the packaging material so that it comprises at least two layers, including an interior layer and an exterior layer, wherein the interior layer of the packaging material adjacent to the sealed container can be penetrated by liquid which escapes from the sealed container, and wherein the exterior layer, the external portion of which is in contact with the external environment, is impermeable by the liquid and by any hazardous vapors therefrom.

At least one of the layers of the packaging material can be capable of immobilizing the liquid. When the immobilizing layer is other than the exterior layer, the exterior layer of the packaging material must be impermeable by at least the immobilized liquid and by any hazardous vapors therefrom.

At least one of the layers of the packaging material can be capable of destroying or deactivating the liquid to a chemical or physical composition which no longer poses a significant hazard to a person exposed to such deactivated composition.

At least one of the layers of the packaging material can be capable of filtering out any etiologic agents so that such etiologic agents remain inside of the exterior layer of the packaging material.

The method of the present invention also comprises a method of containing a hazardous liquid which is leaking from a container, wherein the leaking container is placed in a package which can be sealed so that the package completely surrounds and isolates the leaking container, wherein the improvement comprises constructing the packaging material as described above.

The present invention also pertains to a package for shipment or containment of a hazardous liquid, wherein the package comprises a bag or pouch in which at least one container of the liquid can be sealed so that the package completely surrounds and isolates the container of liquid, wherein, the improvement comprises constructing the bag or pouch so that it comprises:

at least two layers, including an interior layer and an exterior layer, wherein the interior layer of the bag or pouch adjacent to the container of liquid can be penetrated or permeated by liquid which escapes from the container, and wherein the exterior layer of the bag or pouch, the external portion of which is in contact with the ambient environment, is impermeable by the liquid and by any hazardous vapors therefrom.

At least one of the layers of the bag or pouch can be capable of immobilizing the liquid. When the immobilizing layer is other than the exterior layer, the exterior layer of the bag or pouch must be impermeable by at least the immobilized liquid and by any hazardous vapors therefrom.

At least one of the layers of the bag or pouch can be capable of destroying or deactivating the liquid to a chemical or physical composition which no longer poses a significant hazard to a person exposed to such deactivated composition.

At least one of the layers of the bag or pouch can be capable of filtering out any etiologic agents from the liquid.

At least one of the layers of the bag or pouch can be comprised of wicking channels which aid in distribution of the liquid to interior parts of the bag or pouch remote from the area of the container from which liquid is escaping.

At least a portion of at least one of the layers of the bag or pouch can comprise a liquid indicating means, whereby a visual indication that liquid is in direct contact with the interior of the bag or pouch is automatically and continually provided at a location which can be observed from the exterior of the bag or pouch.

BRIEF DESCRIPTION OF THE DRAWINGS

FIG. 1A shows a gusseted bag having one open end, the bottom of the bag having been sealed using an appropriate adhesive or sealant, or by melt flowing an interior heat sealable layer within the bag.

FIG. 1B shows a 3-side seal pouch having a pleat or fold at the bottom which can be used to provide a containment space for escaped liquid.

FIG. 1BB shows a cross section of the pleated bottom of the pouch of FIG. 1B.

FIG. 1C shows another type of 3-side seal pouch, the open end of which can be sealed subsequent to placement of a container of liquid therein.

FIG. 1D shows a 3-side seal pouch having one end chevron sealed. The lower portion of the chevron seal can also be used to provide a containment space for escaped liquid.

FIG. 1E shows a tubular extruded packaging material which has been sealed on one end with the second end open.

FIG. 1F shows a pillow type pouch which is sealed along one side and at one end, having the second end open.

FIG. 1G shows a bag comprised of woven polypropylene fabric, which may have the bottom section stitched or melted into place. Typically the exterior, woven layer of the bag would have a polypropylene film liner. The open end would be gathered together and closed using a sealant.

DETAILED DESCRIPTION OF THE PREFERRED EMBODIMENTS

Figure 1A:
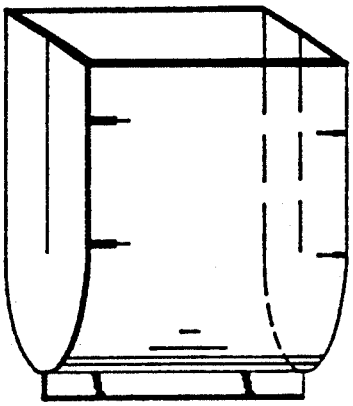
FIGS. 1A–1G show examples of types of bags or pouches which can be used to practice the present invention. The end of the bag or pouch which is shown open is to be sealed subsequent to placement of a container of liquid therein.
Figure 1B:
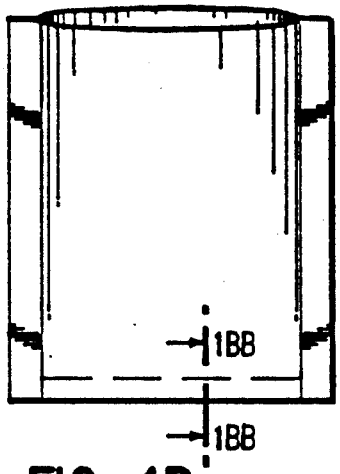
Figure 1B:
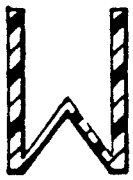
Figure 1C:
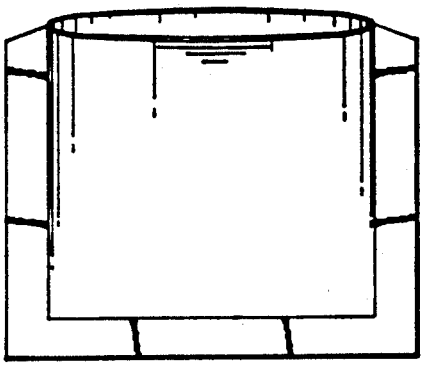
Figure 1D:
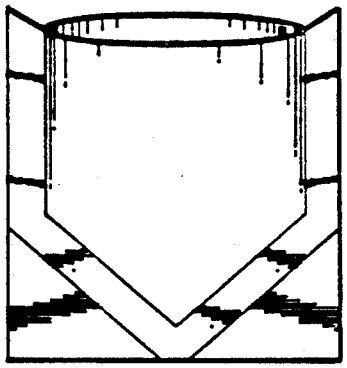
Figure 1E:
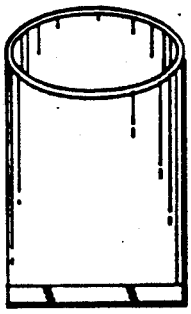
Figure 1F:
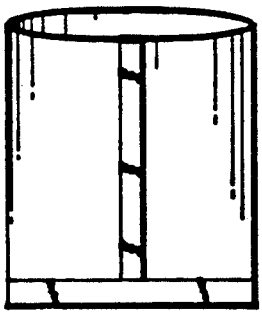
Figure 1G:
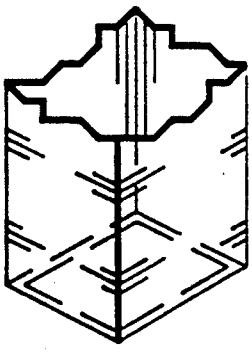

The present invention comprises a method of packaging a hazardous liquid for shipment, wherein the hazardous liquid, present in at least one sealed container, is placed in a package which can be used to completely surround and isolate the sealed container. The present invention also comprises a method of containing a hazardous liquid which is leaking from a container, wherein the leaking container is placed in the package which can be used to completely surround and isolate the leaking container. The improvement over previous methods of packaging and containing hazardous liquids lies in constructing the package to be a sealable bag or pouch which is comprised of material assembled into a structure which can immobilize the hazardous liquid, preventing the transmission of the liquid or hazardous vapor thereof through the exterior of the package.

Hazardous liquids of the type to be contained by the method and packaging of the present invention include biologically active and reactive materials, acids, agricultural chemicals, alcohols and ethers, alkalies, amines, aromatics, chlorinated hydrocarbons, chlorinated solvents, hydrocarbons, ketones, aldehydes and esters, sodium silicates, surfactants of the type which have been demonstrated via toxicity testing to be hazardous, radioactive materials, and other kinds of materials known to pose a danger to plant or animal life or health.

The portion or layer of packaging material capable of immobilizing the liquid can be an adsorbent, an absorbent, a coagulant for the liquid, a gel-forming agent, or combinations thereof. An example of an adsorbent useful for immobilizing aromatic and chlorinated solvents, alcohols and ketones comprises plastic microspheres which are both hydrophobic and polar in nature. Such microspheres are available from Nobel Chemature of Sweden under the tradename of Polyad FB. The Polyad FB materials comprises highly porous plastic microspheres about 0.5 millimeters in diameter, wherein each gram of microspheres provides a surface area of about 800 square meters. The microspheres can withstand a high degree of mechanical stress without rupturing.

Examples of absorbents include fiberous, cotton-like materials of the type described in U.S. Pat. No. 4,495,082 to Mita et al., which is hereby incorporated by reference; cellulosic wadding; paper wadding; superwicking crosslinked polyurethane foam compositions of the type described in U.S. Pat. No. 4,740,528 to Garvey et al., which is hereby incorporated by reference; crystalline, microporous silaceous materials of the kind described in U.S. Pat. No. 4,744,374 to Deffeves et al., which is hereby incorporated by reference; sodium/calcium borosilicate glass microspheres and fibers in general, and particularly mineral fibers of the type described in U.S. Pat. No. 4,748,977 to Guyot et al., which is hereby incorporated by reference; cellulosic material, particularly fiberous products impregnated with a water absorbent acrylic polymer, of the type described in U.S. Pat. No. 4,748,076 to Saotome; monofilaments of fibers of a thermoplastic material, and in particular those having a bilobal-shaped cross sections of the type described in U.S. Pat. No. 4,754,834 to Braun et al., which is hereby incorporated by reference; vermiculite; dry colloidal silica, and similar absorbent materials. One skilled in the art can select an absorbent which is compatible with the liquid to be absorbed.

A coagulant or gel-forming agent to be used in the present invention will also be selected for use with a particular kind of hazardous liquid. Some examples of coagulants include sodium sulfate which is used as a blood coagulant; and fluid thickeners for water-based liquids, such as the hydrocarbyl-substituted succinic acid and/or anhydride/amine terminated poly(oxyalkylene) reaction products of the type described in U.S. Pat. No. 4,661,275 to Forsberg et al., which is hereby incorporated by reference. Gel-forming agent examples include sodium polyacrylate which is recommended for use with aqueous solutions including dilute alkalis, dilute acids and body fluids; and organic gel formers such as carboxymethyl cellulose, cellulose ether, polyvinyl pyrollidone, starch, dextrose, gelatin, and pectin, which are also useful with water-based liquids. One skilled in the art can select from the literature a coagulant or gel-forming agent which is known to be effective with the type of hazardous liquid to be shipped or contained.

In the same manner, a reactive, destructive, or deactivating material to be used in the present invention will depend on the kind of hazardous liquid being shipped or contained. If the hazardous liquid is a chemical compound, the proper reactant is a chemical compound which is known to react with and convert the hazardous chemical compound to a different compound which is not hazardous. When the hazardous liquid is a biological material, the reactive, destructive, or deactivating material is one which terminates or neutralizes the biological activity of the liquid, such as a biocide. When the hazardous liquid is a radioactive material, the reactive material must be capable of reducing the radioactivity of the liquid to a nonhazardous level.

The layer of bag or pouch material which makes up the interior of the package should be permeable to the hazardous liquid or must be perforated, slit, or otherwise constructed to permit the liquid to pass therethrough. Examples of materials which can be used as a permeable interior layer include the wadding and fiberous materials previously described as absorbents, when such materials are formed into a layer of sheeting such as a woven or nonwoven web. For water-based liquids, permeable films of polyvinyl alcohol, low density polyethylene, and nylon are useful. One skilled in the art will select the interior layer material to be permeable to the liquid as necessary, since materials permeable to polar liquids may not be permeable to nonpolar liquids.

The exterior layer of bag or pouch material must be impermeable by the hazardous liquid or hazardous vapors thereof, or must be impermeable by the immobilized hazardous liquid and hazardous vapors thereof. Again, the material selected will depend on the liquid involved. Typically the exterior layer is comprised of a flexible polymeric material. Examples of polymeric materials which can be used to produce such a film for nonpolar liquids include fluorinated polyethylene, and polyvinylchloride. Examples of materials which can be used with water-based liquids include metallized or nonmetallized films of polyester, polypropylene and polyethylene, particularly metallized polyester when sharp edges are a problem and puncture and tear resistance are desired; laminates of paper/low density polyethylene/aluminum foil/low density polyethylene are very functional barriers to water vapor, oxygen, carbon dioxide, and other gases. Woven polypropylene fabric with a polypropylene extrusion coating provides a particularly strong and tough exterior layer; such exterior layers are particularly useful for bags for containment or shipment of large vessels or containers. Coextruded films are functional and less expensive than laminates which require use of an adhesive. Examples of coextruded films include polypropylene coextruded with polyester and polyethylene coextruded with polyester.

An interior layer of low density polyethylene which forms part of a laminate is heat sealable and thus can be used to seal the open end of the bag or pouch after the container of liquid is placed inside. Other means of sealing the bag or pouch include wet bond adhesives, dry bond adhesives, pressure sensitive adhesives and hot melt adhesives, for example. The sealing must be affected or the adhesive so placed as to prevent leakage of the hazardous material. Thus, the sealant or adhesive must be insoluble in and impermeable to the hazardous liquid and the vapors thereof.

EXAMPLE

One embodiment of the present invention is a method and package for the shipment of blood. Glass tubes of a simulated blood liquid were placed in a pouch-type package, absent the styrofoam holding tray previously described, to provide a worst case example. The pouch-type package comprised an interior layer of cellulosic wadding to which was adhered an exterior layer of polyethylene film. The cellulosic waddings investigated ranged in density from about 0.2 grams per square inch to about 0.5 grams per square inch. The wadding was adhered to the polyethylene film using a wet latex adhesive. The polyethylene film thicknesses investigated ranged from about 0.5 millimeters to about 2.5 millimeters plus or minus about 0.2 millimeter. A sharp pressure of a sledge hammer was randomly applied to the exterior surface of the pouch-type package to break the glass.

The simulated blood liquid was observed to leak from the pouch-type package when the packaging material comprised cellulosic wadding having a density of about 0.2 grams per square inch or less combined with a polyethylene film having a thickness of about 0.5 milimeter or less. The broken glass pushed through the wadding and punctured the exterior polyethylene film. It was subsequently discovered that no leakage of the simulated blood liquid from the pouch occurred when the pouch comprised an interior layer of cellulosic wadding having a density of about 0.3 grams per square inch or greater, used in combination with a polyethylene film having a thickness of about 0.5 millimeters or greater. It appeared the cellulosic wadding not only absorbed the simulated blood liquid, but served as a cushion between the broken glass and the polyethylene exterior film, preventing puncture of the polyethylene film. Typically, for shipment of blood samples, the glass tubes of blood are placed in the styrofoam tray preferred for use by laboratory personnel, and the tray containing the tubes is placed inside the package of the present invention. For shipment of such a tray full of samples, the preferred package comprises at least an interior layer of cellulosic wadding having a density ranging from about 0.3 to about 0.5 grams per square inch, used in combination with a polyethylene film ranging in thickness from about 0.5 to about 1.5 millimeters. For a heavier industrial application, the layer of cellulosic wadding should range from about 0.5 to about 1.0 grams per square inch, used in combination with a polyethylene film ranging in thickness from about 0.5 to about 2.5 millimeters.

Examples of bag or pouch structures which provide an improvement over the example described above have been described previously. Typically such improved structures comprise three layers of material, an interior permeable layer, an adjacent layer of absorbent or adsorbent material, and an exterior impermeable layer also adjacent to the absorbent or adsorbent material. A few examples of composite structures which would provide improved performance are shown in FIGS. 2A-2C. 3, and 4.

Figure 2A:
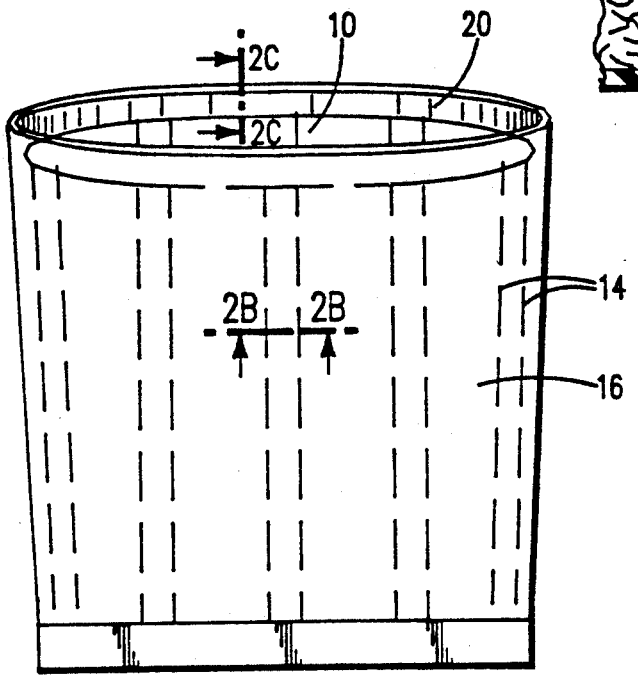
FIG. 2A shows a pouch having wicking channels built in to assist in transporting liquid which has escaped from the container to pouch areas remote from the container location from which the liquid has escaped.
Figure 2B:
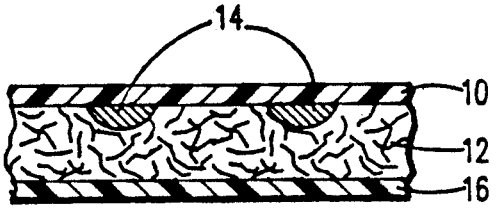
FIG. 2B shows a cross section of the pouch of 2A, the pouch having a permeable layer for an interior surface, with an absorbent material adjacent to the permeable layer, and wherein the absorbent material has been compressed into wicking channels, and having an impermeable exterior layer which is also adjacent to the absorbent material.
Figure 2C:
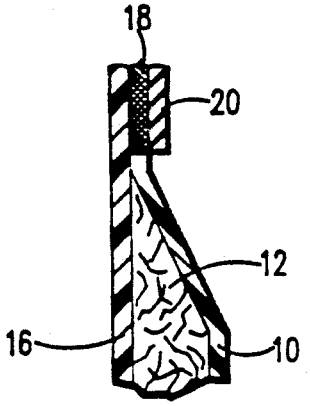
FIG. 2C shows a cross section of the upper, sealable edge of the pouch. The sealable edge comprises the exterior impermeable layer, with a layer of sealant applied to the interior surface of the impermeable layer, and having a release tape applied over the sealant surface, the release tape to be removed prior to sealing the pouch.

Referring to FIGS. 2A-2C, FIG. 2A shows the overall structure of the pouch prior to placement of a hazardous liquid container inside. The pouch has wicking channels built in to assist in transporting liquid which has escaped from the container to pouch areas remote from the container location from which the liquid has escaped. FIG. 2B shows a cross section of the packaging material composite, wherein an interior permeable layer 10 is adhered to or placed proximate to an absorbent material 12 which comprises depressions 14 which function as wicking channels for distribution of liquid which has permeated layer 10. An impermeable exterior layer 16 is adhered to or placed proximate to absorbent material 12. The pouch shown in FIGS. 2A and 2B could also have been fabricated without the wicking channels so long as the absorbent material 12 can transfer the liquid adequately. FIG. 2C shows a cross section of the upper, sealable edge of the pouch. The sealable edge comprises the exterior impermeable layer 16 with a layer of sealant 18 applied to the interior surface of impermeable layer 16. A release tape 20 faces (covers) sealant layer 18 until such time as the bag is to be sealed; at that time release tape 20 is removed and the open edges of the bag comprising sealant 18 are brought together to seal the bag. Exterior impermeable layer 16 may be bonded to permeable layer 10 at a point below sealant layer 18, as shown in FIG. 2C. Depending on the materials used for impermeable layer 16 and permeable layer 10, the bonding may be accomplished by heat sealing or by application of a sealant or adhesive between the two layers. (A sealant or adhesive between layers 16 and 10 is not shown in FIG. 2C.)

Figure 3:
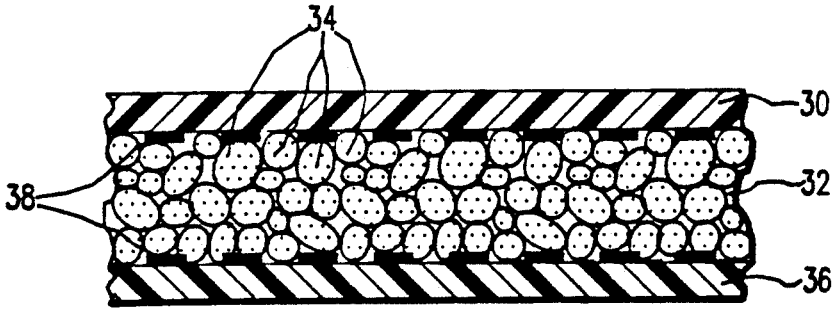
FIG. 3 shows a cross section of a packaging material having an absorbent or adsorbent material which includes a reactant capable of destroying or deactivating the hazardous liquid. The interior, permeable layer and exterior impermeable layer of the packaging material are bonded to the absorbent/adsorbent material using a dot matrix adhesive.

Referring to FIG. 3, a permeable interior layer 30 is adhered or placed proximate to an absorbent 32, which includes a reactant 34 capable of destroying or deactivating the hazardous liquid. An impermeable exterior layer 36 is adhered to or placed proximate to the exposed side of the layer of absorbent 32. In FIG. 3, a dot matrix adhesive 38 is shown bonding permeable interior layer 30 and impermeable layer 36 to absorbent 32.

Figure 4:
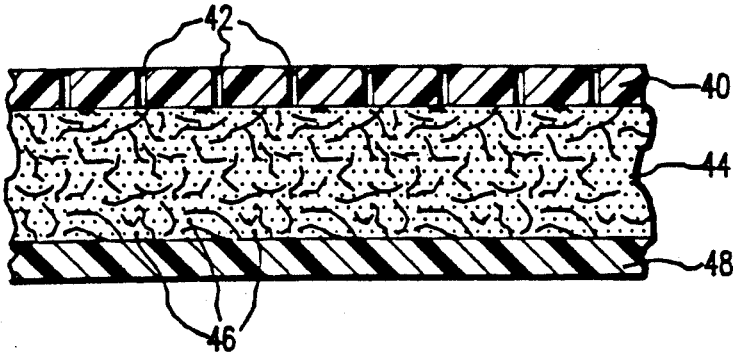
FIG. 4 shows a cross section of a packaging material which comprises a perforated permeable interior layer bonded into intimate contact with a fiberous absorbent which is bonded to a vapor impermeable exterior layer. The fiberous absorbent contains a coagulant or thickening agent.

Referring to FIG. 4, a permeable interior layer 40 comprising perforations 42 is adhered to at least a portion of the fibers making up a first surface of absorbent 44. An exterior impermeable layer 48 is adhered to at least a portion of the fibers making up the second surface of absorbent layer 44. Absorbent layer 44 also comprises a coagulant 46 which further assists in immobilizing the hazardous liquid within absorbent layer 44.

Figure 5A:
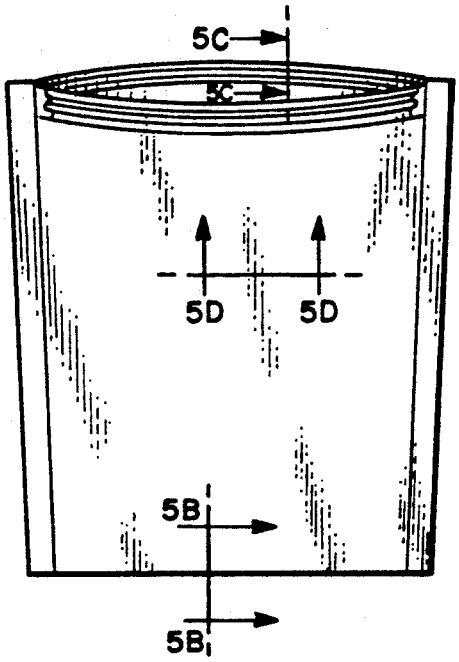
FIG. 5A shows a pouch having a folded bottom and heat-sealed sides, and having an interlocking fastener as the means of closure or sealing of the pouch.
Figure 5B:
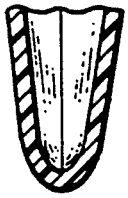
FIG. 5B shows a schematic of the cross section of the pouch at the bottom fold.
Figure 5C:
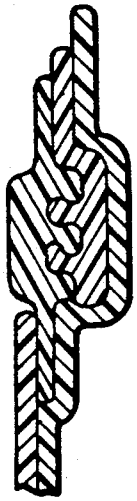
FIG. 5C shows a schematic of the cross section of the pouch at the interlocking fastener/sealer.
Figure 5D:
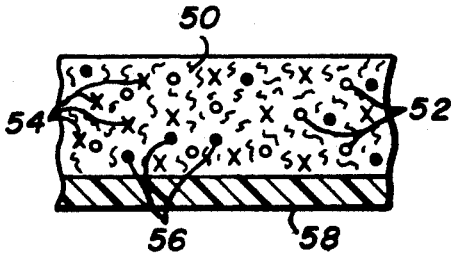
FIG. 5D shows a cross section of composite material which comprises the pouch shown in FIG. 5A. The composite material comprises an interior layer of cellulosic wadding. The wadding contains a coagulant, a biocide, and an absorbent. The wadding layer is adjacent to an exterior impermeable layer comprised of a plastic.
Figure 6:
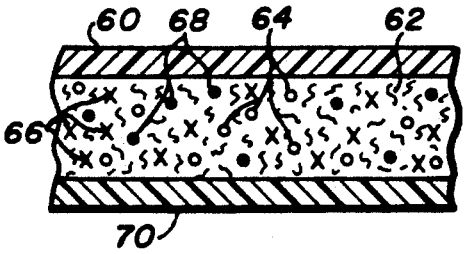
FIG. 6 shows a second, different composite material cross section which can comprise the pouch shown in FIG. 5A. The composite material comprises an interior permeable layer having as an adjacent layer a first side of a layer of cellulosic wadding. The wadding contains a coagulant, a biocide, and an absorbent. The second side of the layer of cellulosic wadding is adjacent to an exterior impermeable layer. The exterior impermeable layer typically comprises a plastic such as polyethylene or polypropylene.

Referring to FIGS. 5A-5D, FIG. 5A shows the overall structure of a pouch comprising a preferred embodiment of the present invention, prior to placement of a liquid container inside. FIG. 5B shows a cross sectional schematic of the fold at the bottom of the pouch. FIG. 5C shows one kind of interlocking closure which can be used to seal the pouch. Use of such a "zip lock" seal of the bag makes the bag reusable. Interlocking fasteners eliminate folding, creasing, and mechanical fasteners that contribute to bag failure and limit reuse. FIG. 5D shows a cross sectional schematic of the pouch material composite, wherein an internal layer of cellulosic wadding 50 which contains a blood coagulant 52, a biocide 54, and an absorbent 56, is adhered to an exterior layer 58 which comprises an impermeable plastic. An alternate cross sectional schematic for the material composite which can be used to fabricate the pouch shown in FIG. 5A is shown in FIG. 6. FIG. 6 shows an interior permeable layer 60 adhered to or placed proximate to a layer of cellulosic wadding 62 which contains a blood coagulant 64, a biocide 66, and an absorbent 68, wherein the wadding 62 is adhered on its other surface to an exterior layer 70 which comprises an impermeable plastic. The most preferred embodiment of the material composite shown in FIGS. 5D and 6 uses a polyacrylate absorbent and a polyethylene exterior layer.

One skilled in the art can calculate the cost of fabricating various packaging material composite structures and determine the combination of materials and relative thicknesses which should provide a cost advantage in manufacture of the packaging. Minimal experimentation combined with cost calculations will enable formulation of a preferred composite structure for a given application. Use of a coagulant or gel-forming agent or a deactivating agent such as a biocide will also depend on the application.

There are numerous possible variations in package structure and composition which can be used to practice the method of the present invention. It is intended that the scope of the present invention not be limited to the specific examples presented herein, but that those variations and modifications which come within the true spirit and scope of the present invention as presented in the appended claims be included.

What is claimed is:

1. A shipping package for safe containment during shipping of a container of hazardous material containing at least one etiologic agent comprising in operative combination:

a) a multi-layer pouch having generally parallel spaced interior and exterior walls defining a central volume for receiving therein a hazardous material secondary container assembly;

b) said multi-layer pouch including as said interior wall a first, interior layer contactable by said container;

c) said interior layer is easily and rapidly permeable throughout its entire interior extent by liquid escaping from said hazardous material container;

d) said multi-layer pouch including as said exterior wall a second, exterior plastic layer having an external surface in contact with the external ambient environment;

e) said exterior layer is impermeable by said liquid and by hazardous vapors from said hazardous material;

f) a seal flap formed from an extension of one exterior wall layer beyond a terminal edge of said interior layer which is sealable to an opposed exterior wall layer to define an opening to said central volume, said pouch upon sealing closure in the area of said flap completely surrounding and isolating said container;

g) seal means for completely adhesively sealing said package opening in said area of said flap so that said seal is impermeable by said hazardous liquid, or the vapors or an etiologic agent from said hazardous material;

h) a third layer of absorbent cellulosic wadding material disposed secured in a place between said first interior layer and said second exterior plastic layer;

i) said interior permeable layer comprises a fibrous, woven or non-woven material which retains said absorbent wadding layer in place and permits rapid passage of liquid therethrough for absorption by said wadding;

j) said absorbent material extending throughout the entire area of said interior layer which defines said central volume, so that upon closure of said flap, said absorbent material substantially completely encloses said hazardous material container, and upon any accidental release of hazardous liquid from said container during shipping there is absorbent material disposed immediately adjacent to any point of leakage through said permeable interior layer;

k) the density of said absorbent wadding material layer being sufficient to contain broken shards from said hazardous material container;

l) at least a portion of said wadding layer includes wicking channels which aid in the distribution of liquid to portions of said wadding remote from the area of said container from which said liquid is escaping;

m) the volume of said absorbent wadding material layer being sufficient to contain and completely absorb all liquid from said hazardous material upon release from said container while said exterior layer prevents leakage of liquid and vapors to the external ambient environment; and n) said adhesive seal providing direct sealing of said opposed exterior wall layers to each other without contacting said first interior layer and said absorbent wadding material.

2. The package of claim 1 wherein said means for completely adhesively sealing said package comprises a strip of adhesive having a release tape thereover, said adhesive strip being disposed to seal said flap to said opposed wall to form a complete seal so that said package is non-reusable.

3. The package of claim 2, wherein said adhesive is selected from the group consisting of wet bond adhesives, dry bond adhesives, pressure sensitive adhesives, and hot melt adhesives.

4. The package of claim 3 wherein:

a) said wadding density is above about 0.3 g/square inch; and b) said exterior impermeable plastic layer has a thickness of greater than about 0.5 mm.

5. The package of claim 4 wherein said wadding density is in the range of from about 0.3 to about 1.0 g/square inch, and said second exterior plastic layer has a thickness in the range of from about 0.5 to about 2.5 mm.

6. The package of claim 1 wherein said third wadding layer contains an additive selected from the group consisting of coagulants, biocides, absorbents, and combinations thereof.

7. The package of claim 1 wherein said cellulosic wadding density is above about 0.3 g/square inch and said second exterior plastic layer has a thickness of greater than about 0.5 mm.

8. The package of claim 7 wherein said wadding density is in the range of from about 0.3 to about 1.0 g/square inch, and said second exterior plastic layer has a thickness in the range of from about 0.5 to about 2.5 mm.

9. The package of claim 1 wherein at least one of said layers of said pouch includes a material having the property of immobilizing said liquid.

10. The package of claim 1 wherein at least one of said layers includes a reactant capable of deactivating said liquid to a chemical or physical composition which no longer poses a significant hazard.

11. The package of claim 10, wherein said reactant has the property of deactivating an etiologic agent.

12. The package of claim 1 wherein at least one of said layers interior of said second exterior plastic layer comprises a material capable of filtering out etiologic agents from said liquid.

13. The package of claim 1 wherein at least a portion of at least one of said layers includes means for visual indication that liquid is in direct contact with said bag or pouch interior which is automatically and continually provided at a location which can be observed from the exterior of said bag or pouch.

* * * * *